US008776663B1

(12) United States Patent
Berman

(10) Patent No.: US 8,776,663 B1
(45) Date of Patent: Jul. 15, 2014

(54) CABIN FOR A HUMVEE VEHICLE

(71) Applicant: Granite Tactical Vehicles Inc., Mount Airy, NC (US)

(72) Inventor: Christopher Berman, Mount Airy, NC (US)

(73) Assignee: Granite Tactical Vehicles Inc., Mount Airy, NC (US)

( * ) Notice: Subject to any disclaimer, the term of this patent is extended or adjusted under 35 U.S.C. 154(b) by 0 days.

(21) Appl. No.: 13/942,555

(22) Filed: Jul. 15, 2013

Related U.S. Application Data

(62) Division of application No. 12/778,951, filed on May 12, 2010, now Pat. No. 8,667,880.

(51) Int. Cl.
*F41H 7/02* (2006.01)

(52) U.S. Cl.
USPC ..... 89/36.08; 89/36.09

(58) Field of Classification Search
USPC ..... 89/36.09
See application file for complete search history.

(56) References Cited

U.S. PATENT DOCUMENTS

| | | | | |
|---|---|---|---|---|
| 4,326,468 | A * | 4/1982 | King et al. | 109/49.5 |
| 5,663,520 | A * | 9/1997 | Ladika et al. | 296/187.07 |
| 7,114,764 | B1 | 10/2006 | Barsoum et al. | |
| 7,685,924 | B2 * | 3/2010 | Barbe et al. | 89/36.09 |
| 8,146,477 | B2 * | 4/2012 | Joynt | 89/36.08 |
| 8,365,649 | B1 * | 2/2013 | Andrews | 89/36.08 |
| 8,424,443 | B2 * | 4/2013 | Gonzalez | 89/36.02 |
| 2005/0257679 | A1 * | 11/2005 | Hass et al. | 89/36.09 |
| 2007/0186762 | A1 * | 8/2007 | Dehart et al. | 89/36.09 |
| 2007/0234896 | A1 * | 10/2007 | Joynt | 89/36.09 |
| 2011/0138994 | A1 * | 6/2011 | Joynt et al. | 89/36.08 |
| 2011/0314999 | A1 * | 12/2011 | Luther et al. | 89/36.02 |
| 2012/0180637 | A1 * | 7/2012 | Kocher | 89/36.08 |
| 2012/0192708 | A1 * | 8/2012 | Kocher et al. | 89/36.08 |

OTHER PUBLICATIONS

Decatur, "Rollover Revolution: Improved trainer helps prepare Soldiers", Air Force Print News Today, Feb. 23, 2007, 1 page.
"Heavier Armored Platforms are Required", Israel Aerospace Industries, Defense Update, http://defense-update.com/20061030_ausa06armor.html#, Oct. 30, 2006, 3 pages.
"Gavial, Caracal and Yak pull ahead Rheinmetall Landsysteme: Supplier of armoured command and multipurpose vehicles", Rheinmetall, Jan. 2006, 3 pages.
"RG-31 Nyala Mine Protected Vehicle", Defense Update, Jul. 4, 2007, 3 pages.

* cited by examiner

*Primary Examiner* — Samir Abdosh
(74) *Attorney, Agent, or Firm* — Orrick Herrington & Sutcliffe LLP

(57) ABSTRACT

The present invention is directed to new and improved armor protection that can replace the existing crew cabin with a field replaceable armored crew compartment to be attached to the existing body of an HMMWV military vehicle to protect the military personnel within from explosive blasts, roll-over or collisions. In accordance with the concepts of the present invention, in order to provide additional protection to personnel in the HMMWV crew compartment, a sacrificial V shaped hull is designed to be attached onto the underside of the crew compartment over the HMMWV frame rails. In the event of an explosion underneath the HMMWV, the V shaped hull will shield the personnel inside the cabin.

19 Claims, 7 Drawing Sheets

V-Hull bolt-on sacrificial center section

CABIN FOR A HUMVEE VEHICLE

CROSS REFERENCE TO RELATED APPLICATIONS

This application is a divisional of U.S. application Ser. No. 12/778,951 filed May 10, 2010. which claims priority to provisional application Ser. No. 61/177,371, filed May 12, 2009, which applications are incorporated herein by reference.

FIELD OF THE INVENTION

The present invention generally relates to armoring of military vehicles. More specifically the present invention relates to armoring of military personnel transportation vehicles.

BACKGROUND OF THE INVENTION

The common vehicle currently selected by the military for the transportation of personnel and for troop patrols is the High Mobility Multipurpose Wheeled Vehicle (HMMWV) commonly referred to as a Humvee. The current method of armoring a HMMWV has generally focused on small arms fire in combat. The escalation of threats in current active combat situations has sent the military looking for further protection. The weak construction of the original body of the HMMWV has made the military conduct an extensive search for additional protection. Thus the continued addition of heavy armor to an already weak body has made the task difficult. Once the main cause of mortality shifted from ballistic threat to blast threat, this method of armoring became even more of a threat to combat troops.

The current method of attaching additional armor to the aluminum body of the HMMWV is weak at best. The failure to have positive attachments between the heavy armor panels stresses the weak aluminum body, which allows the up-armored HMMWV to fold or collapse in a collision or blast. The addition of such up-armor has increased the weight of the vehicle while raising its center of gravity increasing the chance of roll-over and greatly diminishing its mobility and handling. It would be therefore advantageous to find a solution for adding additional protective armor to the existing HMMVV design to protect the military personnel inside the vehicle.

SUMMARY OF THE INVENTION

The present invention is directed to new and improved armor protection that can be attached to the existing body of an HMMWV military vehicle to protect the military personnel within. It is therefore a preferred embodiment of the present invention to replace the existing aluminum HMMWV crew compartment with that of a one piece armored crew compartment that is mounted in the same position as the original crew compartment and utilizes the remaining existing body of the HMMWV. This aspect of the preferred embodiment allows for easy field replacement of the original cabin while increasing the ability of the crew compartment to survive the impact of an explosive blast, collision or roll-over.

In accordance with the concepts of the present invention, in order to provide additional protection to personnel in the HMMWV crew compartment, a sacrificial V shaped hull is designed to be attached onto the underside of the crew compartment over the existing HMMWV frame rails. The existing frame is constructed such that an opening exists underneath the crew compartment making the crew compartment vulnerable to any explosive impact occurring under the vehicle. It is an aspect of the preferred embodiment that the V shaped hull cover the opening in the frame to provide additional protection for the occupants inside the crew compartment. In the event of an explosion underneath the HMMWV, the V shaped hull will shield the personnel inside the cabin from the impact of the explosion. It is also an aspect of the preferred embodiment of the present invention that the V shaped hull is attached with bolts so that it can be removed for replacement or maintenance of the HMMWV. Furthermore, attaching the V shaped hull will maintain much of the original size, shape and function of the HMMWV.

Also in accordance with the concepts of the present invention, the weight of the hull and secondary layer of armor acting as the floor of the vehicle will send weight lower resulting in a lower center of gravity reducing the threat of roll-over. The result of the V shaped hull will require the crew compartment to be raised on the existing frame to return to the original ground clearance and keeping as much of a stand off between crew compartment and blast. This has been accomplished by lowering the body mounts on the new crew compartment to raise it on its original frame mounts.

DESCRIPTION OF THE PREFERRED EMBODIMENTS

Figure 1:
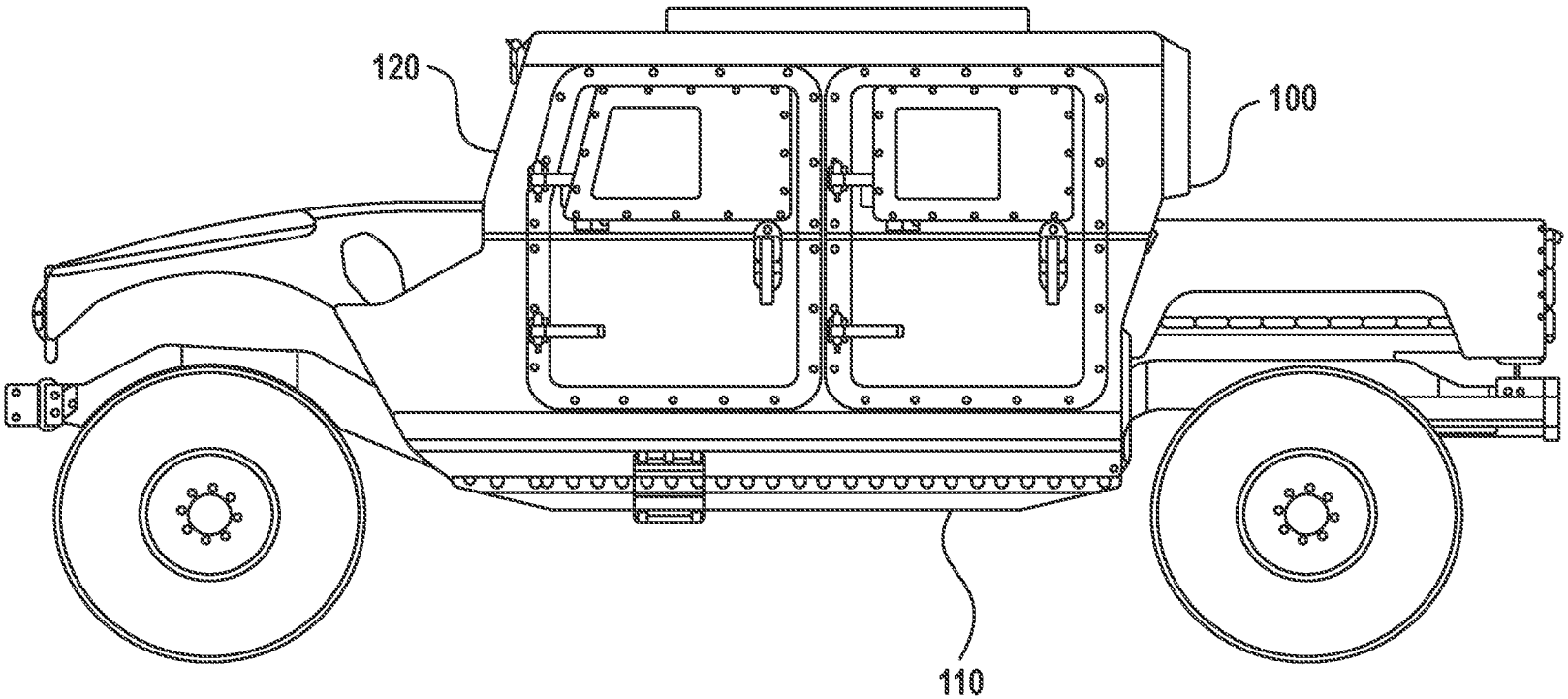
FIG. 1 is a side view of a 4-door HMMWV with armored crew compartment and V shaped hull.
Figure 2:
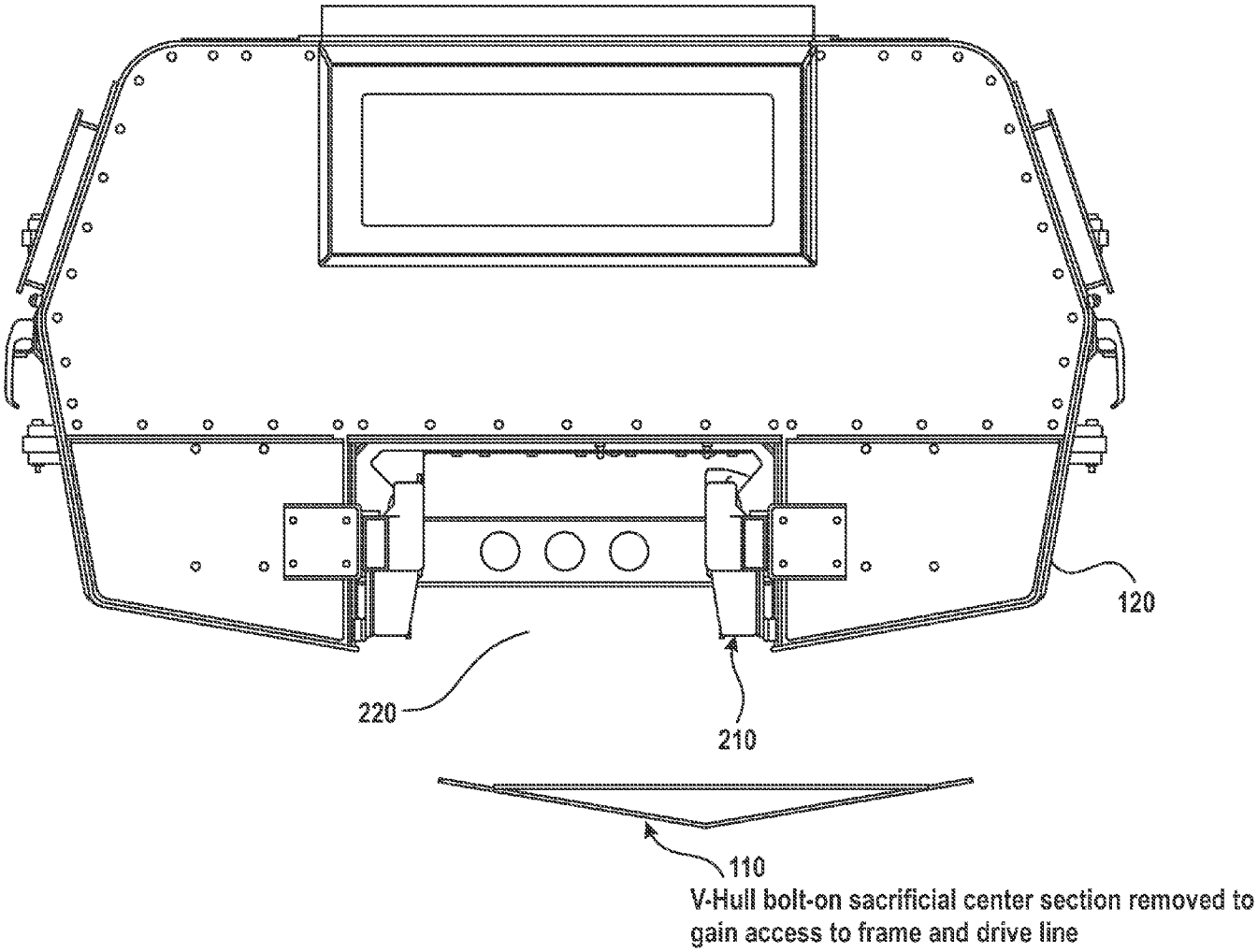
FIG. 2 is a sectional view of the armored crew compartment mounted on the existing HMMWV frame and the detached V shaped hull section.

FIG. 1 is an overall view of a complete HMMWV 100 with the replacement armored crew compartment 120 and V shape hull 110. Turning to FIG. 2, a cross-sectional view of the cabin 120 is shown. The original HMMWV crew compartment is removed from the existing HMMWV frame 210. The original cabin is replaced with a one piece armored crew compartment 120 which is seated onto existing frame 210 maintaining as much of the existing vehicle components as possible. Existing frame 210 has an open chassis 220 below the crew compartment which exposes the occupants inside the compartment to Improvised Explosive Devices (IED) or other explosive devices that may explode underneath the HMMWV. The V shaped hull 110 covers the open chassis 220 to protect the occupants inside the crew compartment 120 from such explosive devices.

The armored crew compartment 120 is designed to be a one piece replacement to the original crew compartment. This allows for easy field replacement of the original compartment. The armored crew compartment 120 is constructed of a rigid metal such as a steel alloy. The one piece armored crew compartment 120 is designed not to collapse in a collision, blast or roll-over. The one piece design and rigid metal construction of the armored crew compartment 120 increases the structural integrity of the crew compartment improving survivability in the event of a roll-over or collision as well as providing added protection from the impact of explosive detonation. The V shaped hull 110 is also constructed of a rigid metal whose composition is such that it will resist the force of a typical IED or other explosive device that detonate beneath the HMMWV 100. The typical composition of the rigid metal is a steel alloy.

Figure 3:
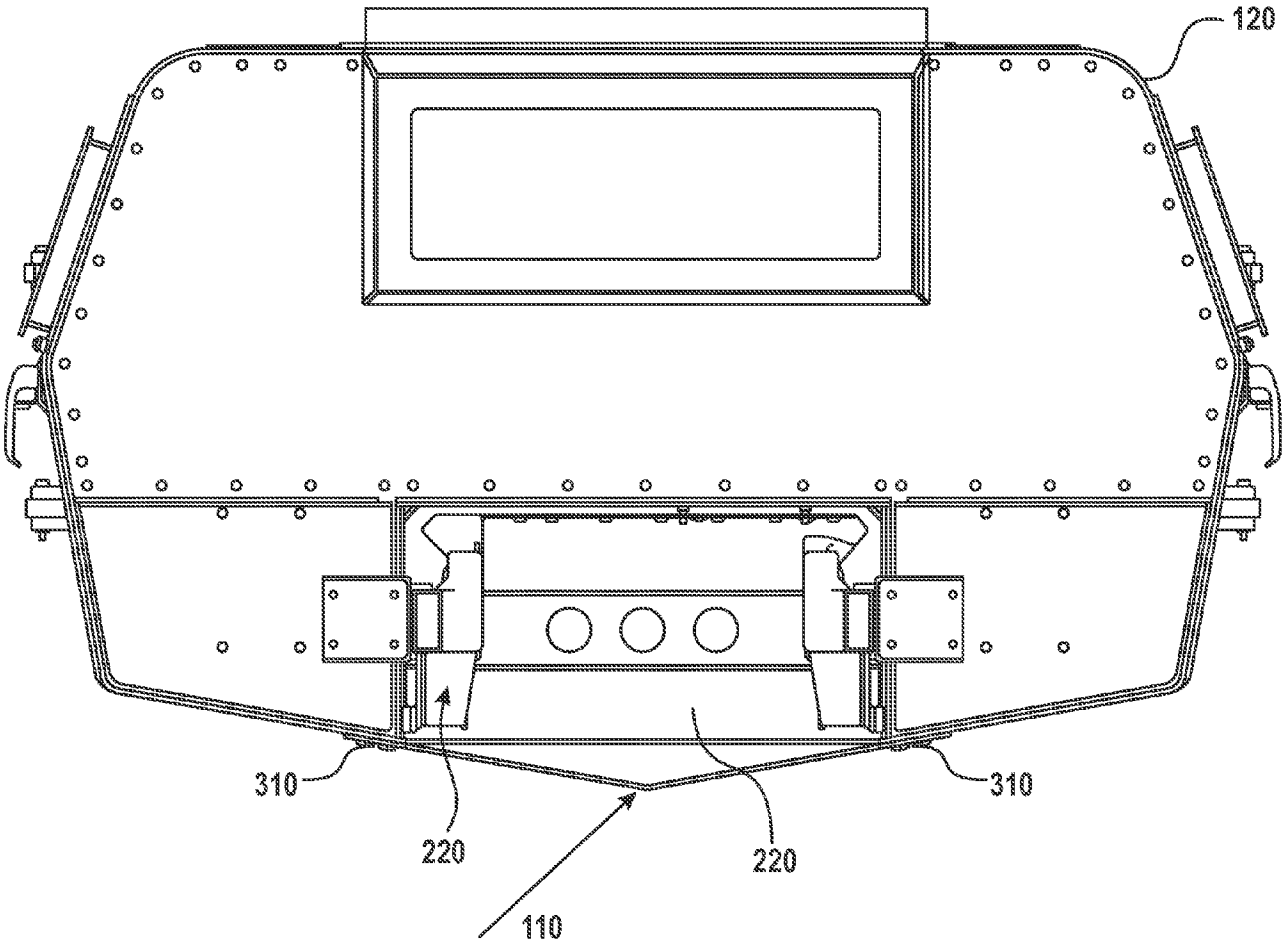
FIG. 3 is a sectional view illustrating the V shaped hull section attached and covering the existing frame.

FIG. 3 illustrates the V shaped hull 110 in its attached position to the armored crew compartment 120. V shaped hull 110 is attached to armored crew compartment 120 with bolts 310. Thus, V shaped hull 110 encloses the existing open chassis 220 to protect the crew compartment 120 from the impact of explosive detonation that occurs underneath the HMMWV 100.

Figure 4:
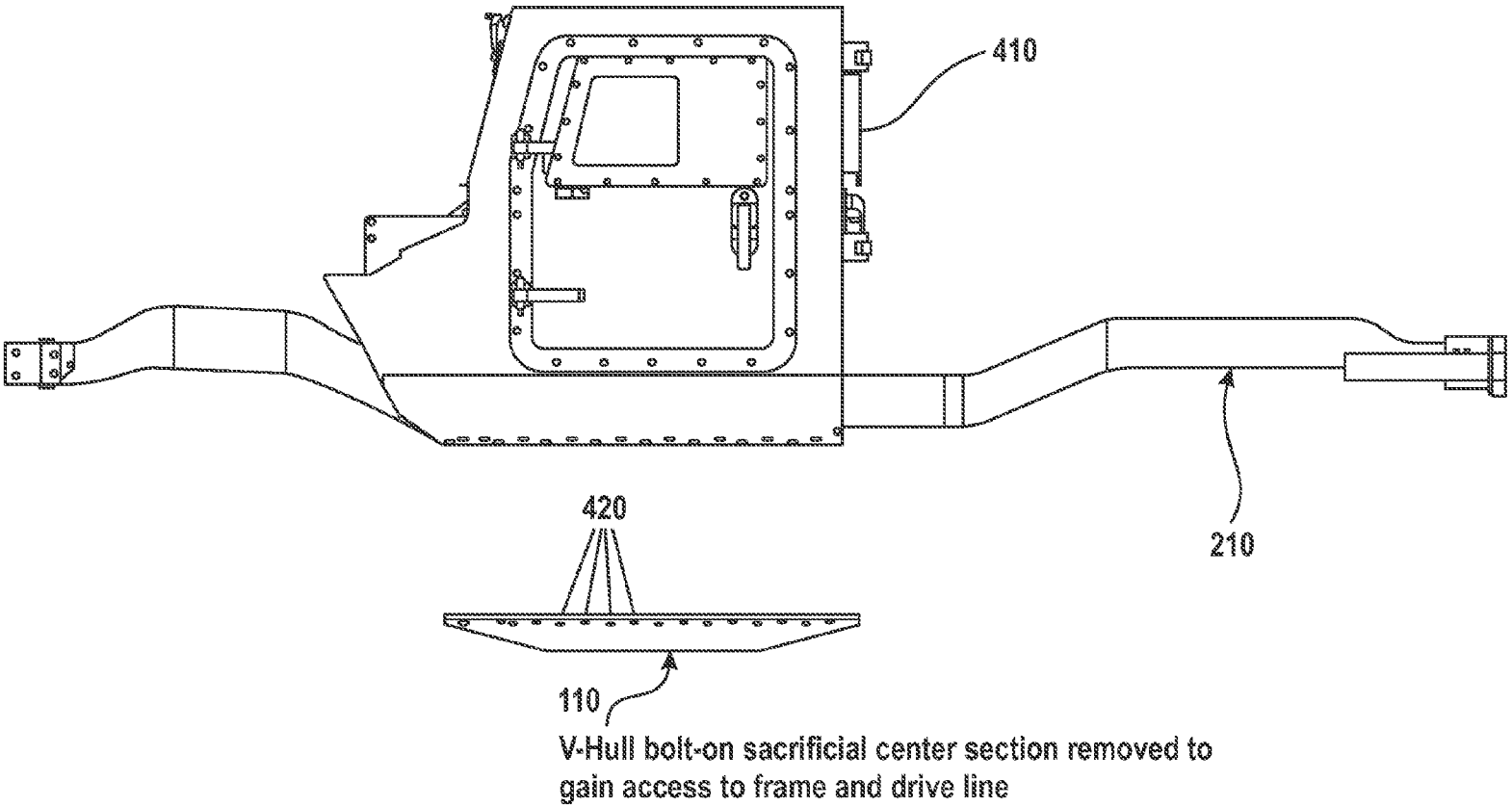
FIG. 4 is a view of the 2 door crew compartment mounted on the existing frame and detached V shaped hull section.
Figure 5:
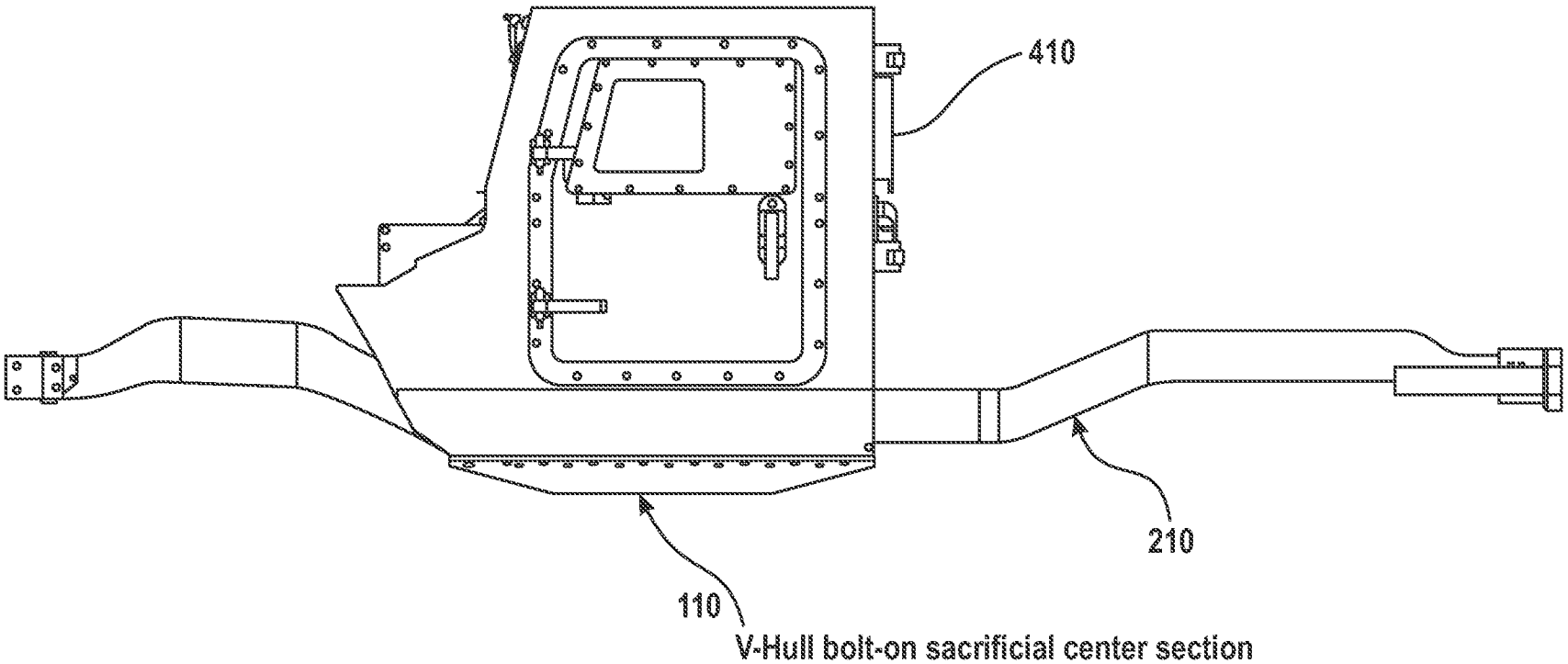
FIG. 5 is a view of the 2-door armored crew compartment and V shaped hull mounted to the existing frame.

FIG. 4 illustrates a 2-door aspect of the present invention. The original crew compartment is removed and the 2-door armored crew compartment 410 is seated onto the original HMMWV frame 210. Crew compartment 410 is attached to frame 210 using as much of the original attachment parts as possible. V shaped hull 110 is sized to fit the underside of the HMMWV 2-door armored crew compartment 410. The V shaped hull 110 is attached to the underside of the HMMWV 2-door armored crew compartment 410 using bolts 420. The V shaped hull 110 is bolted on after the armored crew compartment 410 has been set down over the existing HMMWV frame rails 210. FIG. 5 is a view of the 2-door armored crew compartment 410 with the V shaped hull 110 attached. Bolting of the V shaped hull 110 in this manner maintains as much of the original size, shape and function of the HMMWV as possible and will thereby provide under body protection against explosive devices that may detonate below the HMMWV 100.

Figure 6:
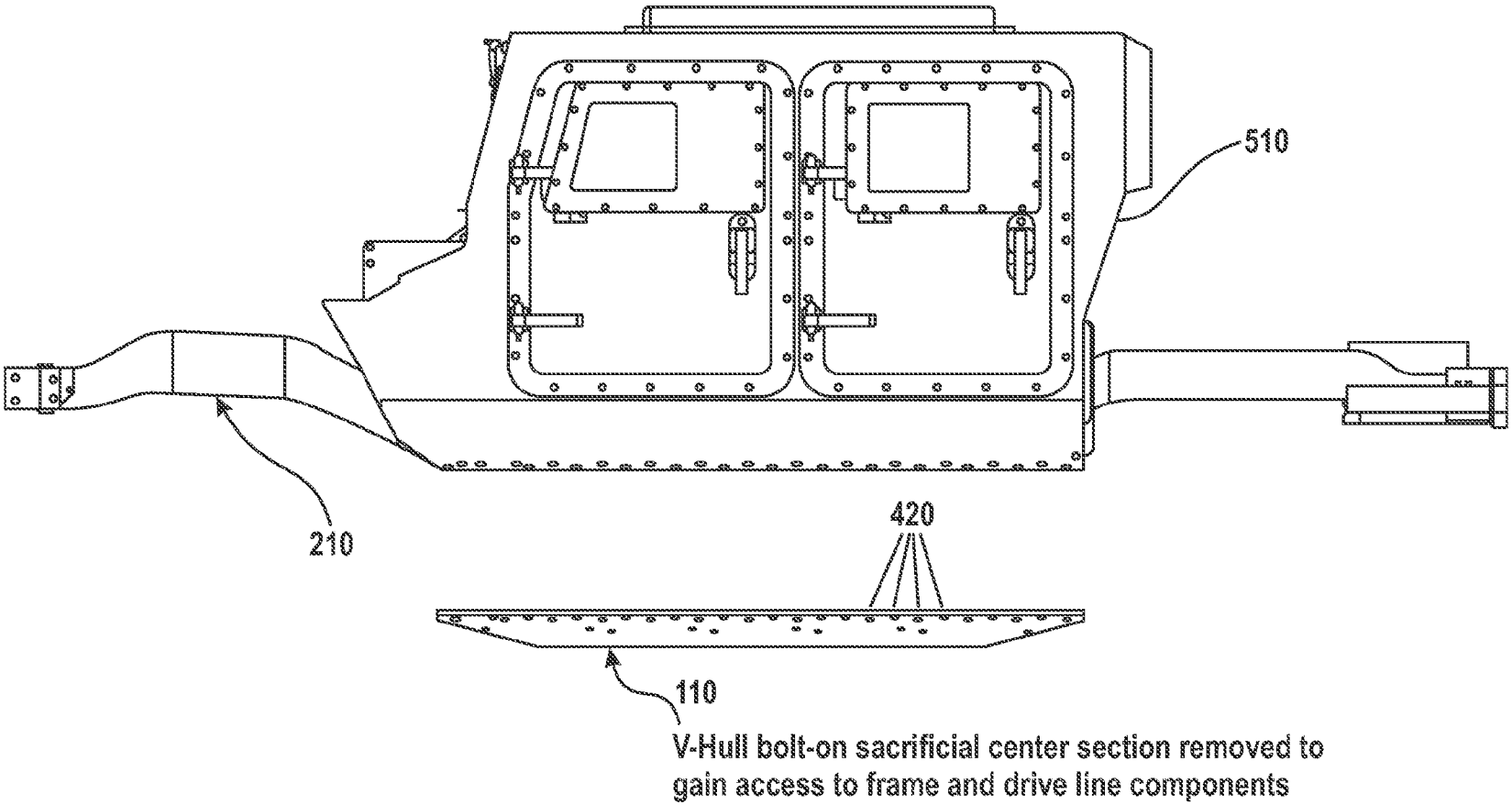
FIG. 6 is a view of the 4 door crew compartment mounted on the existing frame and detached V shaped hull section.
Figure 7:
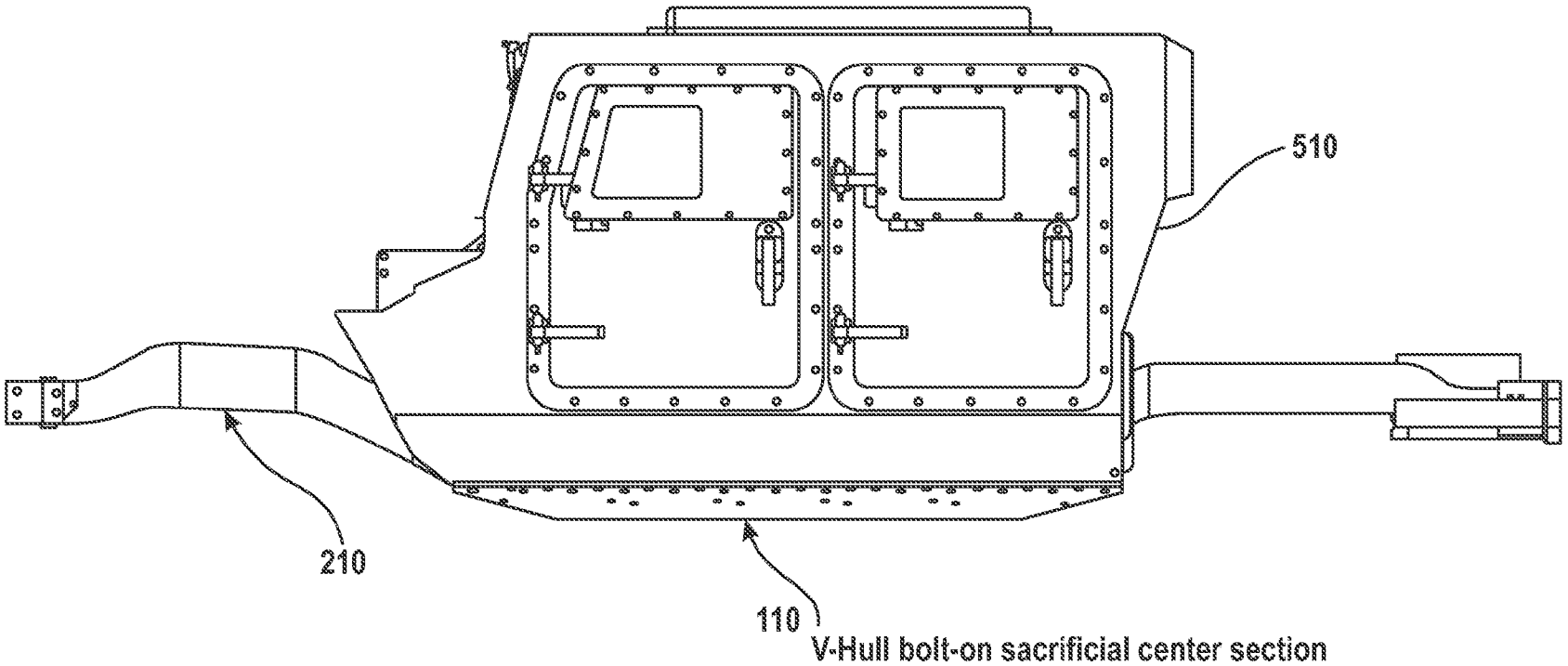
FIG. 7 is a view of the 4 door armored crew compartment and V shaped hull mounted to the existing frame.

FIG. 6 illustrates a 4-door aspect of the present invention. Similarly, the original crew compartment is removed and the 4-door armored crew compartment 510 is seated onto the original HMMWV frame 510. The one piece armored crew compartment 510 is attached to frame 210 using as much of the original attachment parts as possible. V shaped hull 110 is sized to fit the underside of the HMMWV 4-door armored crew compartment 510. The V shaped hull 110 is attached to the underside of the HMMWV 4-door armored crew compartment 510 using bolts 420. The V shaped hull 110 is bolted on after the armored crew compartment 510 has been set down over the existing HMMWV frame rails 210. FIG. 7 is a view of the 4-door armored crew compartment 510 with the V shaped hull 110 attached. As described above, bolting of the V shaped hull 110 in this manner maintains as much of the original size, shape and function of the HMMWV as possible and will thereby provide under body protection against explosive devices that may detonate below the HMMWV 100.

Referring back to FIG. 1, it is another aspect of the present invention that the weight of V shaped hull 110 will send the overall weight of the HMMWV 100 lower resulting in a lower center of gravity reducing the threat of roll-over. The placement of the V shaped hull 110 will require the crew compartment to be raised on the existing frame to return to the original ground clearance which will allow an additional stand off between crew compartment and the force of an explosive detonation. This has been accomplished by lowering the body mounts on the new crew compartment to raise it on its original frame mounts.

Various changes, modifications, variations, as well as other uses and applications of the subject invention may become apparent to those skilled in the art after considering this specification together with the accompanying drawings and claims. All such changes, modifications, variations, and other uses and applications which do not depart from the spirit and scope of the invention are intended to be covered hereby and limited only by the following claims.

The invention claimed is:

1. A method for protecting the occupants in a vehicle from the impact of an explosive detonation, collision or roll-over comprising, removing an original crew compartment from an original chassis of the vehicle, replacing the original crew compartment with a single piece armored crew compartment, and attaching a removable armor shielding device to the underside of the vehicle, wherein the removable armor shielding device covers an opening of the original vehicle chassis.

2. The method of claim 1, wherein the single piece armored crew compartment is configured to directly replace the original crew compartment of the vehicle via armored crew compartment coupling structures that correspond to original crew compartment coupling structures.

3. The method of claim 1, wherein the single piece armored crew compartment is constructed of a rigid metal.

4. The method of claim 3, wherein the said rigid metal includes a steel alloy.

5. The method of claim 1, wherein the said single piece armored crew compartment comprises a crew compartment and a plurality of crew compartment doors.

6. The method of claim 1, wherein the said removable armor shielding device is constructed of a rigid metal.

7. The method of claim 6, wherein the said rigid metal includes a steel alloy.

8. The method of claim 1, wherein the said removable armor shielding device has a V shaped contour.

9. The method of claim 1, wherein the original vehicle chassis comprises an HMMWV chassis.

10. The method of claim 1, wherein the original vehicle chassis comprises an opening below the single piece armored crew compartment.

11. The method of claim 1, wherein the single piece armored crew compartment is configured to surround an open-chassis portion of the original vehicle chassis.

12. The method of claim 11, wherein the removable armor shielding device is configured to couple with the armored crew compartment about the open-chassis portion of the original chassis and cover the open-chassis portion of the original chassis.

13. The method of claim 12, wherein the removable armor shielding device is configured to couple with the armored crew compartment via a plurality of bolts.

14. The method of claim 12, wherein the removable armor shielding device comprises a first plate having a V-shaped contour.

15. The method of claim 14, wherein the removable armor shielding device further comprises a second plate disposed within a concave portion of the first plate.

16. The method of claim 15, wherein the second plate extends from a first V-arm of the first plate to a second V-arm of the first plate.

17. The method of claim 16, wherein the removable armor shielding device is configured to couple with the armored crew compartment proximate to a first V-arm end and proximate to a second V-arm end.

18. The method of claim 15, wherein the second plate is configured to substantially cover an open-chassis orifice defined by the armored crew compartment.

19. The method of claim 1, wherein the armored crew compartment comprises substantially more armoring that the original crew compartment.

* * * * *